US006894609B2

(12) United States Patent
Menard et al.

(10) Patent No.: US 6,894,609 B2
(45) Date of Patent: May 17, 2005

(54) ELECTRICAL POWER CONTROL AND SENSOR MODULE FOR A WIRELESS SYSTEM

(75) Inventors: Raymond J. Menard, Hastings, MN (US); Curtis E. Quady, Burnsville, MN (US)

(73) Assignee: Royal Thoughts, LLC, Minneapolis, MN (US)

( * ) Notice: Subject to any disclaimer, the term of this patent is extended or adjusted under 35 U.S.C. 154(b) by 555 days.

(21) Appl. No.: 09/907,464

(22) Filed: Jul. 17, 2001

(65) Prior Publication Data

US 2003/0016129 A1 Jan. 23, 2003

(51) Int. Cl.[7] ..... G08B 1/00

(52) U.S. Cl. ..... 340/531; 340/506; 340/507; 340/538; 340/539.17; 340/3.1; 340/3.21; 340/539.1

(58) Field of Search ..... 340/539.1, 506, 340/507, 531, 538, 539.17, 3.1, 3.21

(56) References Cited

U.S. PATENT DOCUMENTS

| | | | | |
|---|---|---|---|---|
| 3,843,841 | A | 10/1974 | Rubinstein | 179/5 P |
| 3,969,709 | A | 7/1976 | Isaacs et al. | 340/224 |
| 4,237,344 | A | 12/1980 | Moore | 179/2 A |
| 4,284,849 | A | 8/1981 | Anderson et al. | 179/5 R |
| 4,303,801 | A | 12/1981 | Anderson et al. | 179/5 R |
| 4,463,292 | A | 7/1984 | Engelmann | 318/283 |
| 4,531,527 | A | 7/1985 | Reinhold, Jr. et al. | 128/696 |
| 4,772,876 | A | 9/1988 | Laud | 340/539 |
| 4,789,859 | A | 12/1988 | Clarkson et al. | 340/825.31 |
| 4,843,377 | A | 6/1989 | Fuller et al. | 340/573 |
| 4,856,047 | A | 8/1989 | Saunders | 379/57 |
| 4,908,600 | A | 3/1990 | Martinez | 340/310 R |
| 4,993,059 | A | 2/1991 | Smith et al. | 379/39 |
| 4,994,787 | A | 2/1991 | Kratt et al. | 340/505 |
| 5,016,172 | A | 5/1991 | Dessertine | 364/413.02 |
| 5,025,374 | A | 6/1991 | Roizen et al. | 364/413.02 |
| 5,062,147 | A | 10/1991 | Pickett et al. | 364/900 |
| 5,081,667 | A | 1/1992 | Drori et al. | 379/59 |
| 5,128,979 | A | 7/1992 | Reich et al. | 379/40 |
| 5,144,700 | A | 9/1992 | Martin | 4/415 |
| 5,179,571 | A | 1/1993 | Schilling | 375/1 |
| 5,195,126 | A | 3/1993 | Carrier et al. | 379/45 |
| 5,223,844 | A | 6/1993 | Mansell et al. | 342/357 |
| 5,228,449 | A | 7/1993 | Christ et al. | 128/691 |
| 5,276,728 | A | 1/1994 | Pagliaroli et al. | 379/58 |
| 5,278,539 | A | 1/1994 | Lauterbach et al. | 340/539 |
| 5,319,355 | A | 6/1994 | Russek | 340/573 |
| 5,319,698 | A | 6/1994 | Glidewell et al. | 379/39 |

(Continued)

OTHER PUBLICATIONS

*Skyroute Communications,* http://www.sur–gard.com/skyroute.htm, pp. 1–4, (1974).

"21st Century Emergency Safety Communication Policy", *ComCARE Alliance,* http://www.comcare.org/21ct99.htm, 3 pages, (2000).

(Continued)

*Primary Examiner*—Daryl C. Pope
(74) *Attorney, Agent, or Firm*—Schwegman, Lundberg, Woessner & Kluth, P.A.

(57) ABSTRACT

A module having a switch, a processor, a motion detector and a wireless transceiver. The module controls the operation of an electrical load, such as a light, based on the switch position, programming executing on the processor, an output from the motion detector or an output signal from the transceiver. The module transmits information corresponding to the electrical load, switch position, programming and detected motion. In one embodiment, the module is battery powered. In various embodiments, the module includes an intercom, a high intensity siren, and a photosensor having an output as a function of an ambient light level. In one embodiment, the module is compatible with a wireless communication protocol such as is used with BLUETOOTH®.

30 Claims, 6 Drawing Sheets

U.S. PATENT DOCUMENTS

| | | | | |
|---|---|---|---|---|
| 5,321,963 | A | 6/1994 | Goldman | 70/278.1 |
| 5,327,478 | A | 7/1994 | Lebowitz | 379/40 |
| 5,333,173 | A | 7/1994 | Seazholtz et al. | 379/45 |
| 5,351,235 | A | 9/1994 | Lahtinen | 370/58.1 |
| 5,382,948 | A | 1/1995 | Richmond | 340/825.36 |
| 5,390,238 | A | 2/1995 | Kirk et al. | 379/93 |
| 5,398,782 | A | 3/1995 | Talbot et al. | 187/393 |
| 5,400,246 | A | 3/1995 | Wilson et al. | 364/146 |
| 5,402,466 | A | 3/1995 | Delahanty | 379/44 |
| 5,404,577 | A | 4/1995 | Zuckerman et al. | 455/66 |
| 5,410,292 | A | 4/1995 | Le Van Suu | 340/310.06 |
| 5,412,372 | A | 5/1995 | Parkhurst et al. | 340/568 |
| 5,416,695 | A | 5/1995 | Stutman et al. | 364/413.02 |
| 5,421,178 | A | 6/1995 | Hamel et al. | 70/283 |
| 5,432,841 | A | 7/1995 | Rimer | 379/59 |
| 5,440,301 | A | 8/1995 | Evans | 340/870.11 |
| 5,451,839 | A | 9/1995 | Rappaport et al. | 375/224 |
| 5,485,504 | A | 1/1996 | Ohnsorge | 379/58 |
| 5,486,812 | A | 1/1996 | Todd | 340/539 |
| 5,487,108 | A | 1/1996 | Atkins et al. | 379/355.06 |
| 5,507,162 | A | 4/1996 | Chhatwal | 70/278 |
| 5,513,111 | A | 4/1996 | Wortham | 364/460 |
| 5,552,641 | A | 9/1996 | Fischer et al. | 307/10.5 |
| 5,568,535 | A | 10/1996 | Sheffer et al. | 379/39 |
| 5,570,083 | A | 10/1996 | Johnson | 340/692 |
| 5,583,517 | A | 12/1996 | Yokev et al. | 342/457 |
| 5,583,831 | A | 12/1996 | Churchill et al. | 368/10 |
| 5,587,701 | A | 12/1996 | Hess | 340/541 |
| 5,630,207 | A | 5/1997 | Gitlin et al. | 455/54.1 |
| 5,633,910 | A | 5/1997 | Cohen | 379/38 |
| 5,640,147 | A | 6/1997 | Chek et al. | 340/573 |
| 5,652,564 | A | 7/1997 | Winbush | 340/426 |
| 5,687,215 | A | 11/1997 | Timm et al. | 379/58 |
| 5,689,236 | A | 11/1997 | Kister | 340/545.1 |
| 5,698,095 | A | 12/1997 | Kami | 210/173 |
| 5,712,619 | A | 1/1998 | Simkin | 340/539 |
| 5,719,551 | A | 2/1998 | Flick | 340/426 |
| 5,736,932 | A | 4/1998 | Bulfer et al. | 340/825.34 |
| 5,739,748 | A | 4/1998 | Flick | 340/426 |
| 5,742,233 | A | 4/1998 | Hoffman et al. | 340/573 |
| 5,752,976 | A | 5/1998 | Duffin et al. | 607/32 |
| 5,754,111 | A | 5/1998 | Garcia | 340/573 |
| 5,777,551 | A | 7/1998 | Hess | 340/541 |
| 5,778,315 | A | 7/1998 | Proietti | 455/419 |
| 5,782,118 | A | 7/1998 | Chamberlain et al. | 70/278.3 |
| 5,784,685 | A | 7/1998 | Stanford et al. | 455/31.2 |
| 5,786,746 | A | 7/1998 | Lombardo et al. | 340/286.07 |
| 5,793,283 | A | 8/1998 | Davis | 340/426 |
| 5,812,536 | A | 9/1998 | Manduely | 370/282 |
| 5,815,417 | A | 9/1998 | Orr et al. | 364/578 |
| 5,821,854 | A | 10/1998 | Dorinski et al. | 340/539 |
| 5,825,283 | A | 10/1998 | Camhi | 340/438 |
| 5,845,203 | A | 12/1998 | LaDue | 455/414 |
| 5,850,180 | A | 12/1998 | Hess | 340/541 |
| 5,850,344 | A | 12/1998 | Conkright | 364/479.01 |
| 5,852,408 | A | 12/1998 | Christiansen et al. | 340/870.09 |
| H1782 | H | 2/1999 | Wicks et al. | 340/825.44 |
| 5,870,020 | A | 2/1999 | Harrison, Jr. | 340/426 |
| 5,873,043 | A | 2/1999 | Comer | 455/458 |
| 5,874,889 | A | 2/1999 | Higdon et al. | 340/426 |
| 5,892,442 | A | 4/1999 | Ozery | 340/539 |
| 5,894,591 | A | 4/1999 | Tamayo | 455/31.2 |
| 5,898,391 | A | 4/1999 | Jefferies et al. | 340/988 |
| 5,898,904 | A | 4/1999 | Wang | 455/31.3 |
| 5,902,234 | A | 5/1999 | Webb | 600/300 |
| 5,907,279 | A | 5/1999 | Bruins et al. | 340/506 |
| 5,917,405 | A | 6/1999 | Joao | 340/426 |
| 5,933,080 | A | 8/1999 | Nojima | 340/539 |
| 5,933,086 | A | 8/1999 | Tischendorf et al. | 340/5.22 |
| 5,936,544 | A | 8/1999 | Gonzales et al. | 340/5.22 |
| 5,940,007 | A | 8/1999 | Brinkmeyer et al. | 340/825.69 |
| 5,959,529 | A | 9/1999 | Kail, IV | 340/539 |
| 5,963,136 | A | 10/1999 | O'Brien | 340/573.1 |
| 5,969,595 | A | 10/1999 | Schipper et al. | 340/426.19 |
| 5,983,347 | A | 11/1999 | Brinkmeyer et al. | 713/200 |
| 6,014,626 | A | 1/2000 | Cohen | 704/275 |
| 6,023,223 | A | 2/2000 | Baxter, Jr. | 340/531 |
| 6,023,241 | A | 2/2000 | Clapper | 342/357.13 |
| 6,023,620 | A | 2/2000 | Hansson | 455/419 |
| 6,028,514 | A | 2/2000 | Lemelson et al. | 340/539 |
| 6,029,286 | A | 2/2000 | Funk | 4/223 |
| 6,035,021 | A | 3/2000 | Katz | 379/93.12 |
| 6,035,217 | A | 3/2000 | Kravitz | 455/561 |
| 6,038,896 | A | 3/2000 | Chamberlain et al. | 70/279.1 |
| 6,044,257 | A | 3/2000 | Boling et al. | 455/404 |
| 6,057,758 | A | 5/2000 | Dempsey et al. | 340/539 |
| 6,072,402 | A | 6/2000 | Kniffin et al. | 340/825.31 |
| 6,078,785 | A | 6/2000 | Bush | 455/7 |
| 6,084,510 | A | 7/2000 | Lemelson et al. | 340/539 |
| 6,085,079 | A | 7/2000 | Tabeta | 455/403 |
| 6,087,952 | A | 7/2000 | Prabhakaran | 340/693.5 |
| 6,089,058 | A | 7/2000 | Elpern et al. | 70/279.1 |
| 6,118,866 | A | 9/2000 | Shtivelman | 379/309 |
| 6,147,622 | A | 11/2000 | Fonea | 340/825.31 |
| 6,148,213 | A | 11/2000 | Bertocci et al. | 455/462 |
| 6,160,877 | A | 12/2000 | Tatchell et al. | 379/197 |
| 6,161,005 | A | 12/2000 | Pinzon | 455/403 |
| 6,192,248 | B1 | 2/2001 | Solondz | 455/450 |
| 6,211,787 | B1 | 4/2001 | Yoshiike et al. | 340/573.1 |
| 6,243,010 | B1 | 6/2001 | Addy et al. | 340/539.16 |
| 6,288,641 | B1 | 9/2001 | Casais | 340/539 |
| 6,295,346 | B1 | 9/2001 | Markowitz et al. | 379/127.01 |
| 6,340,928 | B1 | 1/2002 | McCurdy | 340/436 |
| 6,346,889 | B1 | 2/2002 | Moss | 340/686.1 |
| 6,356,192 | B1 | 3/2002 | Menard et al. | 340/359 |
| 6,388,559 | B1 | 5/2002 | Cohen | 340/5.71 |
| 6,388,612 | B1 | 5/2002 | Neher | 342/357.07 |
| 6,442,241 | B1 | 8/2002 | Tsumpes | 379/45 |
| 6,529,723 | B1 | 3/2003 | Bentley | 455/405 |
| 6,542,733 | B1 | 4/2003 | Dennis | 455/433 |
| 6,563,910 | B2 | 5/2003 | Menard et al. | 379/45 |
| 6,567,671 | B2 | 5/2003 | Amin | 455/415 |
| 6,591,094 | B1 | 7/2003 | Bentley | 455/405 |
| 6,608,557 | B1 | 8/2003 | Menard et al. | 340/506 |
| 6,615,414 | B2 | 9/2003 | Miller et al. | 4/321 |
| 6,667,688 | B1 | 12/2003 | Menard et al. | 340/531 |
| 6,671,351 | B2 | 12/2003 | Menard et al. | 379/45 |
| 6,720,861 | B1 | 4/2004 | Rodenbeck et al. | 340/5.64 |
| 6,728,341 | B1 | 4/2004 | Puchek et al. | 379/49 |
| 6,759,956 | B2 | 7/2004 | Menard et al. | 340/539.19 |
| 2001/0056502 | A1 | 12/2001 | Hollstrom et al. | 709/250 |
| 2002/0009184 | A1 | 1/2002 | Shnier | 379/142.01 |
| 2002/0075940 | A1 | 6/2002 | Haartsen | 375/132 |
| 2002/0080029 | A1 | 6/2002 | Menard et al. | 340/541 |
| 2002/0098874 | A1 | 7/2002 | Zirul et al. | 455/564 |
| 2002/0137460 | A1 | 9/2002 | Sun et al. | 455/41.2 |
| 2002/0169539 | A1 | 11/2002 | Menard et al. | 701/200 |
| 2002/0177428 | A1 | 11/2002 | Menard et al. | 455/404 |
| 2002/0178385 | A1 | 11/2002 | Dent et al. | 713/202 |
| 2002/0180582 | A1 | 12/2002 | Nielsen | 340/5.6 |
| 2002/0183008 | A1 | 12/2002 | Menard et al. | 455/66 |
| 2003/0013503 | A1 | 1/2003 | Menard et al. | 455/569 |
| 2003/0091158 | A1 | 5/2003 | Puchek et al. | 379/38 |
| 2003/0156028 | A1 | 8/2003 | Menard et al. | 340/539.1 |
| 2003/0160681 | A1 | 8/2003 | Menard et al. | 340/5.64 |
| 2003/0210140 | A1 | 11/2003 | Menard et al. | 340/531 |
| 2004/0036573 | A1 | 2/2004 | Fitzgibbon et al. | 340/5.64 |
| 2004/0066302 | A1 | 4/2004 | Menard et al. | 340/669 |
| 2004/0100374 | A1 | 5/2004 | Menard et al. | 340/506 |

OTHER PUBLICATIONS

"AlarmNet–A Original Alarmnet", *AlarmNet,* http;//www.ademco.com/AlarmNet/AlarmNetA.htm, pp. 1–2, (2000).
"AlarmNet–C Control Channel Cellular", *AlarmNet,* http://www.ademco.com/AlarmNet/AlarmNetC.htm, 2 pages, (2000).
"AlarmNet–M Mobitex System", *AlarmNet,* http://www.ademco.com/AlarmNet/AlarmNetM.htm, p. 1, (2000).
"allNetDevices:—Geoworks, Openware End Patent Fight", *allNetDevices,* http://www.devices.internet.com/icom_cgi/print/print.cgi?url=http://devices.internet.com/industry/ne...., 1 page, (2000).
"allNetDevices:—The Device–Centric Home in 2000: Close, But No Cigar", *allNetDevices,* http://www.devices.internet.com, 3 pages, (2000).
"ARM7 Thumb Family", *Arm Powered,* Product Information, 4 p., (Prior to May 26, 2000).
"ARM9 Thumb Family", *Arm Ltd.,* Product Information, 6 Pages, (Prior to May 26, 2000).
"Automatic Crash Notification", *ComCARE Alliance,* http://www.comcare.org/overview.htm, 2 pages, (2000).
"Blue–Connect", *Acer NeWeb Corporation,* Product Brief, 1 page, (Prior to May 26, 2000).
"Blue–Share", *Acer NeWeb Corporation,* Product Brief, 1 page, (Prior to May 26, 2000).
"Bluetooth—solutions for personal area networking", *TDK Systems, Inc.,* Manufactures Brochure, 4 pages, (Prior to May 26, 2000).
"Bluetooth Development using SDL, MSC and TTCN", *Teleogic AB,* Product Information, 13 Pages, (Prior to May 26, 2000).
"Bluetooth Product Design—a natural progressionof our existing buiness", *RTX,* Manufactures Brochure, 4 pages, (Prior to May 26, 2000).
"Bluetooth White Paper", *AU–System AB,* Entire Pamphlet, (1999).
"Connect 24 Data Communications", *Connect 24,* http://www.connect24.com, 1 page, (2001).
"CreataLink", *Motorola, Inc.,* 2 pages, (1999).
"CreataLink 2XT", *Motorola,* http://www.motorola.com/MIMS/MSPG/Products/OEM/calxt, 1 page, (Mar. 1999).
"CreataLink 2XT", *Motorola Messaging Products,* www.mot.com/MIMS/MSPG/Products/OEM/calxt/, 1 p., (Mar. 1999).
"Designing Solutions for the Internet Economy", *Intel Developer Forum Spring 2000,* Program Brochure, 2 pages, (Feb. 15–17, 2000).
"Digianswer Bluetooth—Development and Demonstration Tools", *DIGIANSWER A/S,* Product Sheet, 6 pages, (Prior to May 26, 2000).
"DIGIANSWER/Bluetooth Technology", *Digainswer (Irl) Ltd.,* Product Information, 8 Pages, (Prior to May 26, 2000).
"Emergency 911 Cellular Phone and Cellular Phone Accessories", *AAA Communications,* http://web.idirect.com/aaa/, pp. 1–7, (2001).
"Emergency Terms", *Glossary,* http://www.comcare.org/glossary.htm, 3 pages, (2000).
"Empowering the mobile enterprise", *Puma Technology, Inc.,* Manufactures Brochure, 2 pages, (1996–1999).
"Emulation System Speeds Development of CDMA Satcom Handsets", *Penton Publishing, inc.,* Product Information, 4 Pages, (1997).
"Enabling Innovation", *Arm Ltd.,* Product Brochure, 10 Pages, (1999).
"Get a better vantage point and outmaneuver the competition", *Cadence Design Systems, Inc.,* Manufactures Brochure, 2 pages, (1999).
"Introduction to the HomeRF Technical Specification", *HomeRF,* pp. 1–17, (2000).
"IVT—Bluetooth Protocol Stack SDL/C Source Code", *Bluthtooth,* Product Brochure, 2 pages, (Prior to May 26, 200).
"Lucent Technologies and Bluetooth", *Lucent Technologies, Inc.,* Manufactures Brochure, 2 pages, (Dec. 1999).
"ObjectGEODE—The Most Advanced Integrated Enviornment for the Development of Distributed Real–time Systems", *VERILOG S.A.,* Entire Brochure, (1998).
"ORA Electronics Introduces Rescue Mate, a Complete Cellular Telephone Safety Package; Hands–Free Operation, Instant Emergency 911 Access, Roadside Assistance Services", *Business Wire,* http://www.findarticles.com, 2 pages, (1998).
"OSE—the new generation realtime operating system", *ENA OSE Systems,* Informational Brochure, Entire booklet, (1999).
"PSAP Updates and Third–Party Call Centers", *ComCARE Alliance,* http://www.comcare.org/psap.htm, 2 pages, (2000).
"Samsung Electronics joins home radio frequency group in development of wireless network for the home", *Samsung Electronics,* http://www.samsung.com/news/samsung/1998/sea0305.html, pp. 1–2, (1998).
"Socket's Bluetooth Cordless Communications Card FAQ", *Socket Communications, Inc.,* Informational Literature, 2 pages, (Dec. 1999).
"Spontaneous Connections", *CommVerqe,* 6 pages, (May 2000).
"Tachless Remote Engine Starters", *Almex,* http://www.almexltd.com/iei/mantis1200.htm, pp. 1–3, (2000).
"Technology Solutions for Bluetooth from Ericsson Microelectronics", *Erricson Components AB,* Manufactures Brochure, 2 pages, (Nov. 1999).
"The Ericsson Bluetooth Development Kit—Faster launching of Bluetooth Products", *Ericsson Mobile Communications, AB,* Manufactures Brochure, 2 pages, (1999).
"The Secret of Success!", *SIGnal Newsletter—The Official Newsletter of the Bluetooth Special Interest Group,* Issue No. 3, 8 Pages, (Nov. 1999).
"UMTS W–DCMA Technology Development Using the Aptix System Explorer MP4 for Algorithm Verification", *Aptix Corporation,* Product Information, 4 Pages, (1999).
"Unleash the World—Core technology for Bluetooth applications", *Ericsson Mobile Communications AB,* Manufactures Brochure, 7 pages, (1999).
"Will the push—not pull—of Internet information dramatically alter out Web interactions", *Sunworld,* http://www.sunworld.com, 6 pages, (2000).
"Wireless Connections Made Easy", *Bluetooth,* Manufactures Brochure, 19 Pages, (Prior to May 26, 2000).
"Your Vision—Our Solution", *RTX Telcom,* Manufactures Brochure, 6 pages, (Prior to May 26, 2000).
Houston, J., "Socket Teams with Cambridge Silicon Radio for Bluetooth Cordless Networking on Windows CE", *Socket Communications, Inc.,* Press Release, 2 pages, (1999).
Nobel, C., "Microsoft jumps on the Bluetooth bandwagon", *PC Week,* 1 page, (Dec. 6, 1999).

Posti, J., "Motorola Introduces CreataLink 2 XT ReFLEX Two–way Data Transceiver for Wireless Communications", *Motorola Press Release,* www.mot.com/MIMS/MSPG/Press/PRI9990303_21575.html, 2 p., (Mar. 1999).

"Freehand Remote Control Lock", *Remote Control Lock Instruction Manual,* KDL, Inc., (1997),pp. 1–15.

Fitzgibbon, J. J., "Method and Apparatus for Providing Access to a Dwelling Via a Remote Signal", U.S. Appl. No. 60/175,749, filed Jan. 12, 2000, 22 pgs.

Menard, Raymond J., et al., "Assisted Personal Communication System and Method", U.S. Appl. No. 10/719,672, filed Nov. 21, 2003, 25 pgs.

Menard, Raymond J., et al., "Bi–Directional Wireless Detection System", U.S. Appl. No. 09/372,249, filed Aug. 11, 1999, 36 pgs.

Menard, Raymond J., et al., "Bi–directional Wireless Detection System", U.S. Appl. No. 10/757,367, filed Jan. 14, 2004, 35 pgs.

Menard, Raymond J., et al., "Bi–directional Wireless Detection System", U.S. Appl. No. 09/956,474, filed Sep. 19, 2001, 38 pgs.

Menard, Raymond J., et al., "Detection System using Personal Communication Device with Response", U.S. Appl. No. 10/322,374, filed Dec. 17, 2002, 17 pgs.

Menard, Raymond J., "Emergency Communication and Monitoring System and Method", U.S. Appl. No. 10/165,221, filed Jun. 7, 2002, 29 pgs.

Menard, Raymond J., "Emergency Response Information Distribution", U.S. Appl. No. 10/409,661, filed Apr. 7, 2003, 35 pgs.

Menard, Raymond J., et al., "Interactive Motion Sensitive Sensor", U.S. Appl. No. 10/601,330, filed Jun. 20, 2003, 46 pgs.

Menard, Raymond J., et al., "Long Range, Bidirectional, Wireless Personal Communication System", U.S. Appl. No. 09/277,805, filed Mar. 27, 1999, 25 pgs.

Menard, Raymond J., et al., "Method and System for Wireless Tracking", U.S. Appl. No. 10/112,669, filed Mar. 28, 2002, 79 pgs.

Menard, Raymond J., et al., "Modular Communication System and Method", U.S. Appl. No. 09/579,913, filed May 26, 2000, 68 pgs.

Menard, Raymond J., et al., "Remote Notification of Monitored Condition", U.S. Appl. No. 10/112,690, filed Mar. 28, 2002, 75 pgs.

Menard, Raymond J., et al., "Systems and Methods for Transmitting Signals to a Central Station", U.S. Appl. No. 10/640,876, filed Aug. 13, 2003, 18 pgs.

Puchek, Daniel R., et al., "Monitoring and Communication System for Stationary and Mobile Persons", U.S. Appl. No. 10/254,048, filed Sep. 23, 2002, 41 pgs.

Puchek, Daniel R., et al., "Monitoring and Communication System for Stationary and Mobile Persons", U.S. Appl. No. 09/315,739, filed May 20, 1999, 38 pgs.

Webb, Nicholas, "Medical Communication System for Ambulatory Home–Care Patients", U.S. Appl. No. 08/880,817, filed Jun. 27, 1997, 30 pgs.

ELECTRICAL POWER CONTROL AND SENSOR MODULE FOR A WIRELESS SYSTEM

TECHNICAL FIELD OF THE INVENTION

The present invention relates generally to the field of wireless control and monitoring and, in particular, to a system for controlling and monitoring electrical power to a load.

BACKGROUND OF THE INVENTION

A concern for personal safety has compelled many people to install a home security system. A typical security system includes a number of sensors distributed throughout the house and a security alarm panel. A keypad, often positioned near an entry door and connected to the alarm panel, allows the owner to arm or disarm the system. The sensors are configured to detect intruders or other hazardous conditions, such as fire or smoke. The security alarm panel is often connected to a telephone line and is programmed to contact a remote facility if the sensors detect an alarm condition. The remote facility is staffed by operators who contact a local dispatch service to respond to the alarm condition.

For many people, the advantage of protection offered by a security alarm system is outweighed by recognized problems. Among the recognized problems of security system are the high monetary costs of the system. The fixed costs of the many sensors, the keypad, the control panel, and wiring discourage many from investing. Professional system design, installation and continuous monitoring are additional costs. Furthermore, many people find that, with time, the task of arming and disarming the system becomes an excessively routine burden with no tangible benefit. The occasional false alarm, and any penalty fees assessed by the monitoring service or emergency service, further dissuade diligent use of a security system. Eventually, the system falls into disuse and the homeowner regrets having made the investment.

Another example of a modem convenience that has languished in the marketplace is a wireless remote control. With few exceptions, wireless remote control of home appliances has not yet received broad public acceptance. Television and video cassette recorder (VCR) remote controls, and garage door openers often use proprietary signaling protocol and are thus, limited in functionality. For example, a remote control for use with a particular television is incapable of controlling a garage door opener. Furthermore, the range of such devices is limited. Also, most such remote controls do not provide feedback to the user to indicate changes or settings in the controlled device. Thus, it appears that the range of most remote controls is, as a practical matter, limited by the user's ability to see the changes made.

For the reasons stated above, and for other reasons stated below which will become apparent to those skilled in the art upon reading and understanding the present specification, there is a need in the art for an improved security system and remote control system. The system should overcome the problems enumerated above and provide additional benefits beyond those of known systems.

SUMMARY OF THE INVENTION

The above mentioned problems are addressed by the present invention and will be understood by reading and studying the following specification. A system and method is described which enables controlling and monitoring electrical power to a load. The load, for example, may include an electrical light. In one embodiment, the system and method can be tailored to operate as a security system having remote control and monitor functions.

In one embodiment, the system includes a module integrated with an electrical switch. The module may be installed in a wall mounted electrical box with a decorative faceplate. Terminals on the module are connected to electrical wires in the same manner as an ordinary switch. The electrical switch operates in a familiar manner for turning a load, such as a light, on or off. In addition, the module includes a motion detector and a wireless transceiver, also coupled to the electrical switch. The motion detector portion of the module generates a signal when a person is detected within a protected area. The transceiver provides a wireless link that allows data or instructions to be uploaded, or sent, to the module and data or instructions to be downloaded, or received, from the module.

As used herein, the phrase "light switch" is used in the popular and generic sense. While the switch of the present module may be connected to an incandescent light, it may also be connected to other electrical devices or appliances. For example, the switch may be connected to a wall outlet. In such a case, a lamp, or other appliance connected to the wall outlet, can be controlled by the present module.

In one embodiment, the module operates as an automatic light switch. In one embodiment, a signal generated by the motion detector element will cause the light to turn on, just as though the user operable switch had been toggled. A signal may be generated by a person passing in front of the motion detector. Thus, the light can be toggled on and off when a person enters, and later, exits a room by passing the motion detector.

In one embodiment, the module may operate as a security system. In this case, a person detected by the motion detector element will trigger an alarm signal. In one embodiment, the alarm signal turns on a siren coupled to the module. The siren may include a piezoelectric sounder.

In one embodiment, the alarm signal is transmitted to a second device using a radio frequency transmission or by other wired or wireless means. For example, the signal may be transmitted to the second device by modulating a signal on the electrical power network throughout the home or building. The second device, also coupled to the electrical power network in the building, demodulates the signal and further relays the alarm signal using another communication network or activates a siren. The signal may be transmitted to a second device by a wireless radio frequency (RF) transmitter. In this case, the second device includes a wireless receiver. As above, the second device may further relay the alarm signal, using another communication network, or activate a siren.

In one embodiment, the module may function as part of a remote control system. In this case, a portable device can be used to transmit a signal to the wall mounted module. The portable device may include a cellular telephone or it may include a pager. The module receives and decodes the transmitted signal and executes instructions accordingly. The signal may include instructions to turn the light on or off or set a schedule for operating the light. The signal may also include instructions for the module to perform a self test and report the results using a specified communication protocol. In one embodiment, the module may include an electrical outlet receptacle and the present subject matter, thus, may control electrical power available from the outlet or power actually consumed by a load coupled to the outlet. In one embodiment, the module is adapted for mounting within a wall mounted electrical junction box. In one embodiment, the module is adapted for coupling between a standard electrical outlet and an electrical load. The electrical load may include an appliance such as a lamp, fan, radio, or other electrical device adapted for operation using power drawn from metered electric service.

The geographical range of communication can be extended by linking the wall mounted module with a second device that is coupled to a long distance communication network. For example, in one embodiment, the wall mounted module includes a transceiver compatible with a communication protocol known popularly as BLUETOOTH®, and a second device, located within range of the module, also includes a BLUETOOTH® transceiver as well as an interface coupled to the Internet. BLUETOOTH® is a protocol for digital data transmission over a short range link and was developed as a replacement for cables between computer devices. Where the second device is coupled to the Internet, a remote user can communicate with the wall mounted module using a browser. Thus, a remote personal computer can be used to control and monitor an electrical load connected to the module.

The system, including the switch, transceiver, motion detector, and other circuitry can be mounted in an Underwriters Laboratories (UL) standard electrical box. Depending upon the system configuration and programming, the signal from the motion detector can, for example, be used to arm or disarm a security system, power or unpower a light fixture, or sound an alarm signal. In one embodiment, the wireless transceiver can be configured to communicate with a remote device or wireless module that, together, forms a security system.

Various embodiments include additional elements that provide enhanced functionality. For example, the wall mounted module may include a photosensor that generates a signal based on ambient light conditions. The signal may be used to control the operation of the module. As another example, the wall mounted module may include an audio transducer. The transducer may be part of an intercom system or it may include a siren that audibly signals an alarm condition. As another example, the wall mounted module may included a battery power supply. The battery power supply is sufficient to power the transceiver (or other communication module), an internal processor and the motion detector.

DETAILED DESCRIPTION OF THE INVENTION

In the following detailed description of the preferred embodiments, reference is made to the accompanying drawings which form a part hereof, and in which is shown by way of illustration specific illustrative embodiments in which the invention may be practiced. These embodiments are described in sufficient detail to enable those skilled in the art to practice the invention, and it is to be understood that other embodiments may be utilized and that logical, mechanical and electrical changes may be made without departing from the spirit and scope of the present invention. The following detailed description is, therefore, not to be taken in a limiting sense.

Figure 1:
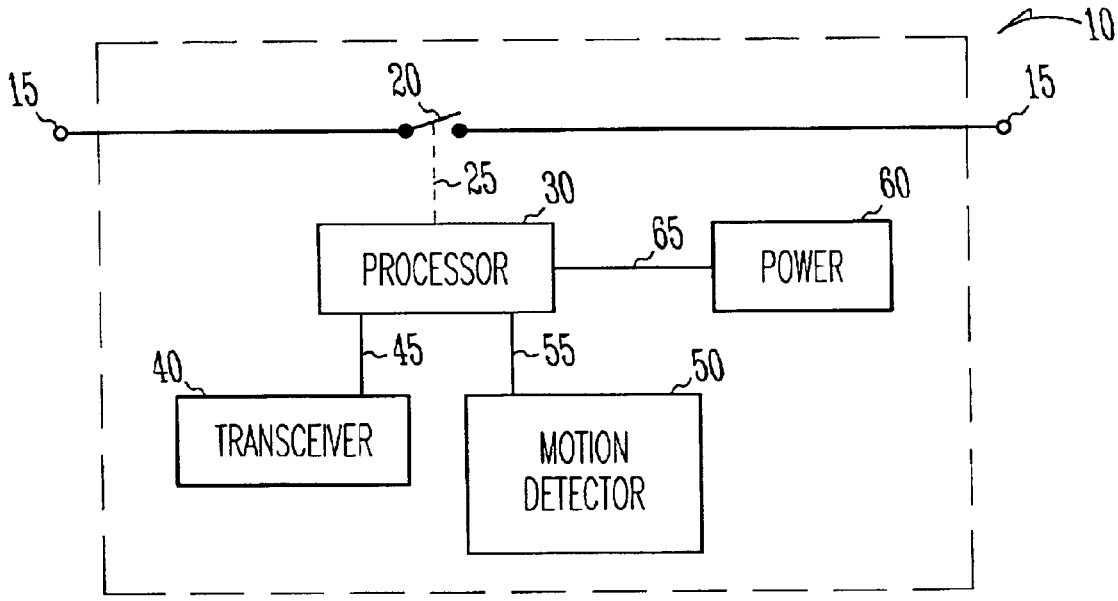
FIG. 1 schematically illustrates an embodiment of the present system.

FIG. 1 schematically illustrates a block diagram of one embodiment of module 10. Module 10, illustrated by the dashed box, includes switch 20, processor 30, power supply 60, transceiver 40 and motion detector 50. Switch 20 is coupled to processor 30 by dashed line 25 to indicate that positional information relative to switch 20 is provided to processor 30, and thus, the positional information is available for processing. Also, dashed line 25 indicates that processor 30 can control the electric current flowing between the terminals labeled 15. In one embodiment, processor 30 controls the position of switch 20, and thus, the current flowing between terminals 15. In one embodiment, processor 30 controls the position of switch 20 using an electromechanical actuator. Line 45 indicates that signals, and data, can be exchanged between processor 30 and transceiver 40. Line 55 indicates that signals, and data, can be exchanged between processor 30 and motion detector 50. Line 65 indicates that signals, data, and power can be exchanged between processor 30 and power supply 60.

In the figure, switch 20 is illustrated as single pole, single throw switch having two external terminals 15. In one embodiment, switch 20 has an operable lever handle that moves a conductive member which closes or opens an electrical circuit.

In one embodiment, processor 30 includes a microprocessor having a memory and an executable program with instructions for operating in the manner described herein. Processor 30 may include a programmable logic controller, logical gates or electrical circuits. Memory may include storage for program instructions and data.

In one embodiment, transceiver 40 communicates using a wireless protocol. Transceiver 40 may communicate using analog or digital signals. In one embodiment, transceiver 40 couples with terminals 15 and communicates by modulating a signal on electrical power wiring distributed throughout a house or building. A demodulator, also coupled to the electrical power wiring, receives and demodulates the signal. The demodulator may be coupled to another communication network to further extend the range of the communication link. Programming for processor 30 can be uploaded to module 10 by transmitting instructions and data to transceiver 40 using a compatible transmitter coupled to a remote processor, such as, for example, a personal computer.

Motion detector 50 may include a passive infrared (PIR) motion detector. The signal generated by motion detector 50 may be a digital or analog signal. In one embodiment, detector 50 includes a digital signal processor.

In one embodiment, power supply 60 includes a connection to a power source supplying power to the electrical load.

For example, power supply 60 may include a connection to 110 volt AC metered service. In addition, or alternatively, power supply 60 includes a battery. The battery may be a rechargeable battery, such as a nickel-cadmium (nicad) battery.

Figure 1A:
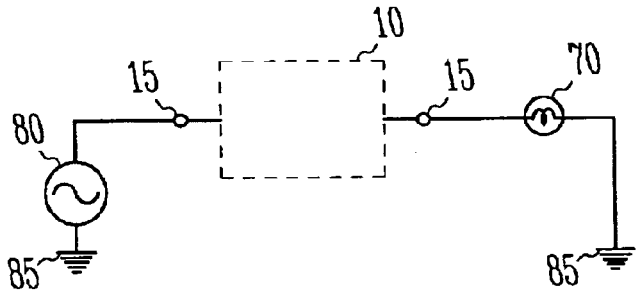
FIG. 1A schematically illustrates an electrical circuit including an embodiment of the present system.

FIG. 1A illustrates an electrical schematic including an embodiment of module 10. In the figure, power source 80 has a first terminal shown coupled to ground 85 and a second terminal coupled to a first terminal 15 of module 10. A second terminal 15 of module 10 is coupled to a first terminal of load 70. A second terminal of load 70 is also coupled to ground 85. Load 70 may include a light bulb (such as an incandescent bulb), a radio, a computer or an electromechanical device or actuator. Load 70 may be any type of electrical device that can be controlled by adjusting the current in a supply line.

Figure 2:
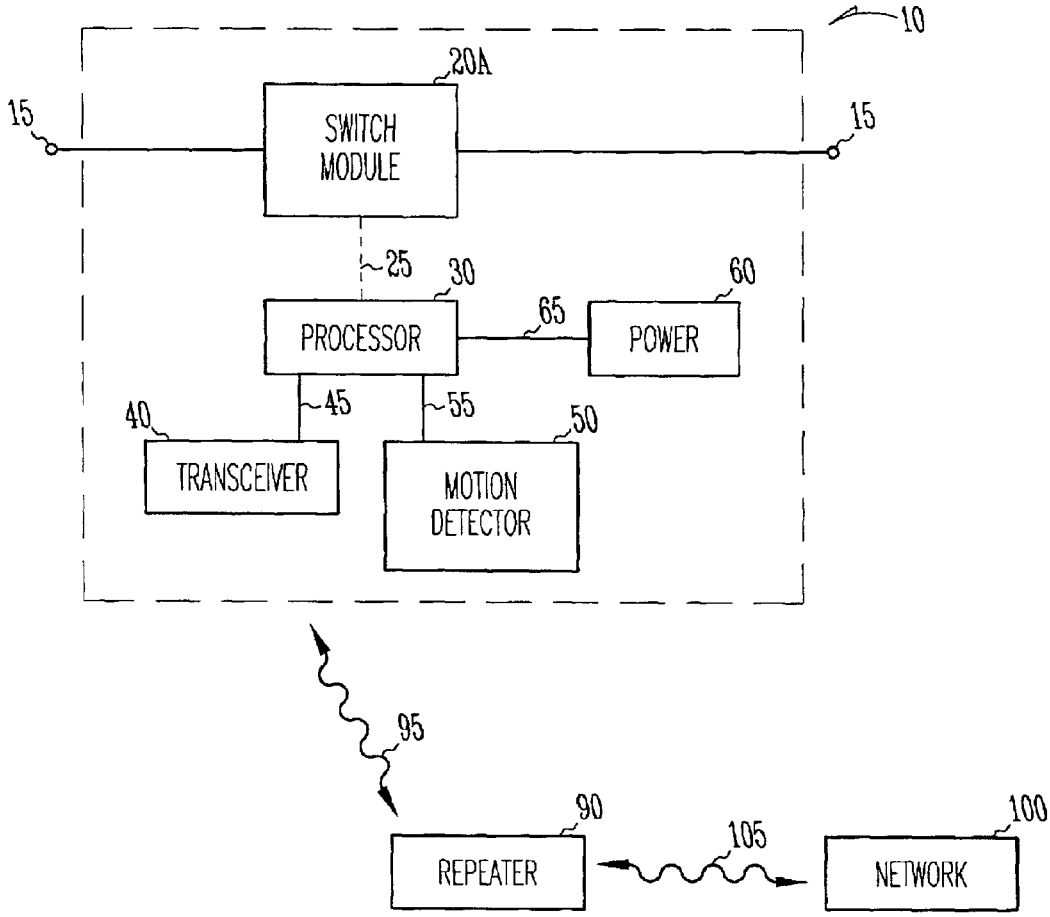
FIG. 2 schematically illustrates an embodiment of the present system operating in conjunction with a network.

FIG. 2 illustrates a system having module 10 coupled to repeater 90 by link 95 and to network 100 by link 105. In the figure, switch module 20A is coupled to terminals 15. Terminals 15 may include pigtail leads, screw connectors, friction grip connectors or other means of connecting to the building wiring.

Switch module 20A may include a lever handle switch or a push button switch or it may include a semiconductor device suitable for switching current to a load. For example, switch module 20A may include a silicon controlled rectifier (SCR) subject to control by processor 30. Switch module 20A may include an electromechanical relay operated by a magnetic field. In one embodiment, switch module 20A has multiple poles or multiple positions and more than two terminals. In one embodiment, switch module 20A includes an adjustable resistance, such as a rheostat or potentiometer.

In the figure, transceiver 40 communicates with repeater 90 using link 95. Transceiver 40 may transmit and receive wireless communications. In one embodiment, transceiver 40 includes a wireless receiver and transmitter able to communicate using a short range communication protocol. For example, in one embodiment, transceiver 40 is compatible with BLUETOOTH® communication protocol. In general, the effective communication range of BLUETOOTH® is relatively short, often characterized as approximately 10 meters. The short range capabilities of BLUETOOTH® are suitable for premises-based applications, such as data exchange within a range roughly equal to the lineal boundaries of a typical property, or premises.

It will be further appreciated that with a suitable repeater, gateway, switch, router, bridge or network interface, the effective range of communication of transceiver 40 may be extended to any distance. For example, repeater 90 may receive transmissions on a BLUETOOTH® communication protocol and provide an interface to connect with network 100, such as the public switched telephone network (PSTN) using link 105. In this case, a wired telephone at a remote location can be used to communicate with wall mounted module 10. As another example, the range may be extended by coupling a BLUETOOTH® transceiver with a cellular telephone network, a narrow band personal communication systems ("PCS") network, a CELLEMETRY® network, a narrow band trunk radio network or other type of wired or wireless communication network.

According to one definition, and subject to the vagaries of radio design and environmental factors, short range may refer to systems designed primarily for use in and around a premises and thus, the range generally is below a mile. Short range communications may also be construed as point-to-point communications, examples of which include those compatible with protocols such as BLUETOOTH®, HomeRF™, and the IEEE 802.11 WAN standard (described subsequently). Long range, thus, may be construed as networked communications with a range in excess of short range communications. Examples of long range communication may include, Aeris MicroBurst cellular communication system, and various networked pager, cellular telephone or, in some cases, radio frequency communication systems.

Figure 3:
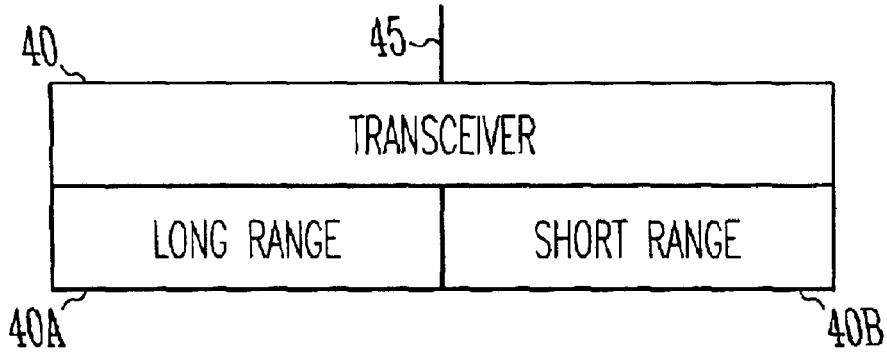
FIG. 3 illustrates a transceiver in accordance with one embodiment of the present system.

FIG. 3 illustrates an embodiment of transceiver 40. In the figure, transceiver 40 is compatible with both a long range communication protocol and a short range communication protocol. In one embodiment, the long range transmissions are communicated by section 40A and short range transmissions are communicated by section 40B.

For example, a person located a long distance away, such as a mile, from module 10 may communicate with transceiver 40 using a cellular telephone compatible with the long range protocol of section 40A. In one embodiment, programming executing on processor 30 provides information to generate a message to be delivered to a remote cellular telephone. The message may appear on a display of the cellular telephone or it may appear as an audible sound or an inaudible vibration of the cellular telephone. The message provides feedback to the user to indicate the status of module 10, load 70 connected to module 10, and other information. For example, if the user issues a command to module 10 using the cellular telephone, then the display of the phone will indicate the changes arising from the command. In one embodiment, the cellular telephone, or other device, displays real time information from module 10.

Various methods may be used to send a message or instruction to module 10 from a remote location. For example, using a cellular telephone, a user may speak a particular phrase, word or phoneme that is recognized by the cellular telephone which then generates and transmits a coded message to module 10. As another example, the user may manipulate a keypad on the telephone to encode and transmit a message to module 10.

Examples of devices compatible with such long range protocols include, but are not limited to, a telephone coupled to the public switched telephone network (PSTN), a cellular telephone, a pager (either one way or two way), a personal communication device (such as a personal digital assistant, PDA), a computer, or other wired or wireless communication device.

Long range communication protocols may include, but are not limited to, cellular telephone protocols, one way or two way pager protocols, and PCS protocols. Typically, PCS systems operate in the 1900 MHZ frequency range. One example, known as Code-Division Multiple Access (CDMA, Qualcomm Inc., one variant is IS-95) uses spread spectrum techniques. CDMA uses the full available spectrum and individual messages are encoded with a pseudo-random digital sequence. Another example, Global Systems for Mobile communications (GSM), is one of the leading digital cellular systems and allows eight simultaneous calls on the same radio frequency. Another example, Time Division Multiple Access (TDMA, one variant known as IS-136) uses time-division multiplexing (TDM) in which a radio frequency is time divided and slots are allocated to multiple calls. TDMA is used by the GSM digital cellular system. Another example, 3G, promulgated by the ITU (International Telecommunication Union, Geneva, Switzerland) represents a third generation of mobile communications technology with analog and digital PCS representing first and second generations. 3G is operative over wireless air interfaces such as GSM, TDMA, and CDMA. The EDGE (Enhanced Data rates for Global Evolution) air interface has been developed to meet the bandwidth needs of 3G. Another example, Aloha, enables satellite and terrestrial radio transmissions. Another example, Short Message Service (SMS), allows communications of short messages with a cellular telephone, fax machine and an IP address. Messages are limited to a length of 160 alpha-numeric characters. Another example, General Packet Radio Service (GPRS) is another standard used for wireless communications and operates at transmission speeds far greater than GSM. GPRS can be used for communicating either small bursts of data, such as e-mail and Web browsing, or large volumes of data.

In one embodiment, a long range communication protocol is based on one way or two way pager technology. Examples of one way pager protocols include Post Office Code Standardisation Advisory Group (POCSAG), Swedish Format (MBS), the Radio Data System (RDS, Swedish Telecommunications Administration) format and the European Radio Message System (ERMES, European Telecommunications Standards Institute) format, Golay Format (Motorola), NEC-D3 Format (NEC America), Mark IV/V/VI Formats (Multitone Electronics), Hexadecimal Sequential Code (HSC), FLEX™ (Motorola) format, Advanced Paging Operations Code (APOC, Philips Paging) and others. Examples of two way pager protocols include ReFLEX™ (Motorola) format, InFLEXion™ (Motorola) format, NexNet™ (Nexus Telecommunications Ltd. of Israel) format and others.

In one embodiment, transceiver 40 is compatible with a two-way pager network allowing bidirectional communication between a BLUETOOTH®-enabled module, or device, and a user controlled pager. In one embodiment, the long distance network may include a telephone network which may include an intranet or the Internet. Coupling to such a network may be accomplished, for example, using a variety of connections, including a leased line connection, such as a T-1, an ISDN, a DSL line, or other high speed broadband connection, or it may entail a dial-up connection using a modem. In one embodiment, the long distance network may include a radio frequency or satellite communication network. In addition, one or more of the aforementioned networks may be combined to achieve desired results.

Short range communication protocols, compatible with section 40B, may include, but are not limited to, wireless protocols such as HomeRF™, BLUETOOTH®, wireless LAN (WLAN), or other personal wireless networking technology. HomeRF™, currently defined by specification 2.1, provides support for broadband wireless digital communications at a frequency of approximately 2.4 GHz.

BLUETOOTH® is a trademark registered by Telefonaktiebolaget LM Ericsson of Stockholm, Sweden and refers to short range communication technology developed by an industry consortium known as the BLUETOOTH® Special Interest Group. BLUETOOTH® operates at a frequency of approximately 2.45 GHz, utilizes a frequency hopping (on a plurality of frequencies) spread spectrum scheme, and provides a digital data transfer rate of approximately 1 Mb/second. In one embodiment, the present system includes a transceiver in compliance with BLUETOOTH® technical specification version 1.0, herein incorporated by reference. In one embodiment, the present system includes a transceiver in compliance with standards established, or anticipated to be established, by the Institute of Electrical and Electronics Engineers, Inc., (IEEE). The IEEE 802.15 WPAN standard is anticipated to include the technology developed by the BLUETOOTH® Special Interest Group. WPAN refers to Wireless Personal Area Networks. The IEEE 802.15 WPAN standard is expected to define a standard for wireless communications within a personal operating space (POS) which encircles a person. In one embodiment, the transceiver is a wireless, bidirectional, transceiver suitable for short range, omnidirectional communication that allows ad hoc networking of multiple transceivers for purposes of extending the effective range of communication. Ad hoc networking refers to the ability of one transceiver to automatically detect and establish a digital communication link with another transceiver. The resulting network, known as a piconet, enables each transceiver to exchange digital data with the other transceiver. According to one embodiment, BLUETOOTH® involves a wireless transceiver transmitting a digital signal and periodically monitoring a radio frequency for an incoming digital message encoded in a network protocol. The transceiver communicates digital data in the network protocol upon receiving an incoming digital message.

In one embodiment, transceiver 40 is compatible with a communication protocol using a control channel. One such example is CELLEMETRY®. CELLEMETRY® is a registered trademark of Cellemetry LLC of Atlanta, Ga., USA, and enables digital communications over a cellular telephone control channel. Other examples of communication technology are also contemplated, including MicroBurst™ technology (Aeris.net, Inc.).

Other long range and short range communication protocols are also contemplated and the foregoing examples are not to be construed as limitations but merely as examples.

Transceiver 40 may be compatible with more than one communication protocols. For example, transceiver 40 may be compatible with three protocols, such as a cellular telephone communication protocol, a two-way pager communication protocol, and BLUETOOTH® protocol. In such a case, a particular wall mounted module 10 may be operable using a cellular telephone, a two-way pager, or a device compatible with BLUETOOTH®. As another example, switch 20 position information may be received on a pager protocol and a user may transmit a command to operate load 70 using a cellular telephone protocol.

In one embodiment, module 10 can communicate with a remote device using more than one communication protocols. In the figure, a long range and a short range protocol are represented. Module 10 may include programming to determine which protocol to use for communicating.

The determination of which communication protocol to use to communicate with a remote device may be based on power requirements of each transceiver, based on the range to the remote device, based on a schedule, based on the most recent communication from the remote device, or based on any other measurable parameter. In one embodiment, module 10 communicates simultaneously using multiple protocols.

In one embodiment, signals generated by module 10 are received by a central monitoring station. The central monitoring station may include operators that provide emergency dispatch services. An operator at the central monitoring station may also attempt to verify the authenticity of a received alarm signal. In one embodiment, the alarm signal generated by module 10 is first transmitted to a user, using either a short range or long range communication protocol, who then may forward the alarm signal to a monitoring station if authentic or cancel the alarm signal if the alarm is not valid.

In one embodiment, module 10 may communicate with a building control or security system by communicating using transceiver 40. For example, module 10 may operate as an auxiliary input to a building control or security system. In which case, if module 10 detects a security event, then an alarm signal is transmitted from module 10, via transceiver 40, to the building security system. The building security system, if monitored by a central monitoring station, then forwards the alarm signal to the monitoring station. In one embodiment, module 10 can receive a transmission from a separate building control or security system. If the building security system detects an alarm condition, then the security system can, for example, instruct module 10 to repeatedly toggle power to load 70 by actuating switch 20. A flashing light visible from the exterior of the building may aid emergency personnel in locating an emergency site. Alternatively, module 10 can establish communications with a predetermined remote device or a central monitoring service.

In one embodiment, transceiver 40 includes an external, or remote, antenna. The remote antenna may provide an increased communication range. When mounted in a metal electrical box, shielding effects may reduce the communication range of transceiver 40.

Figure 4:
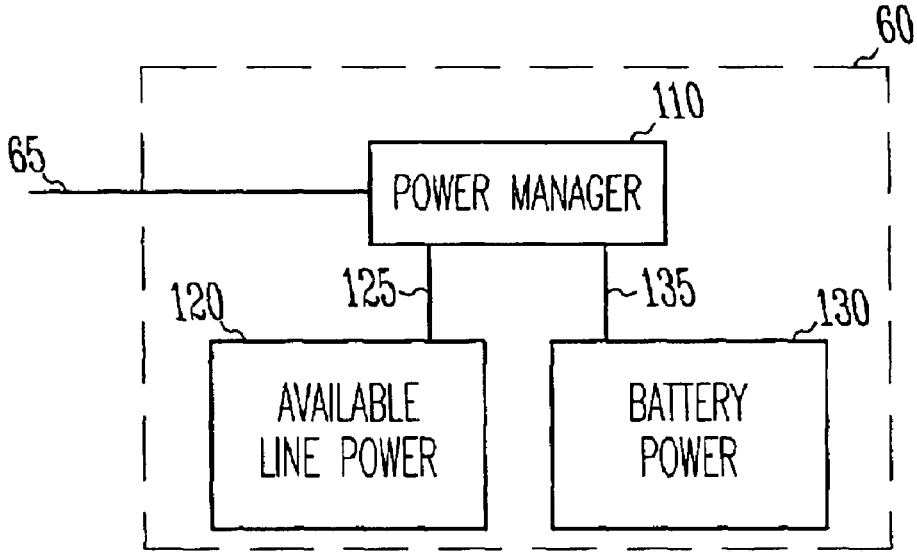
FIG. 4 illustrates a power module in accordance with one embodiment of the present system.

FIG. 4 illustrates a power supply in one embodiment of the present system. In the figure, line 65 indicates that signals, data and power can be exchanged between the processor 30 and power supply 60. Power supply 60, in the embodiment shown, includes power manager 110 coupled to available line power 120 and battery power 130 by lines 125 and 135, respectively. Lines 125 and 135 may communicate signals, data and power. Power manager 110, alone, or in conjunction with processor 30, monitors and manages line power 120 and battery power 130. Line power 120 may include a separate connection to an electrical power supply providing 110 volts AC or other standard supply voltage. In one embodiment, line power 120 is drawn from the power supplied to load 70. In one embodiment, line power 120 is coupled to terminals 15. Line power 120 may include a transformer, voltage regulator, rectifier, filter, and other power supply elements. In one embodiment, battery power 130 includes a battery. Battery power 130 may include a rechargeable or non-rechargeable battery. For example, battery power 130 may include a gel-cell battery or a nickel-cadmium battery. In one embodiment, power to recharge battery power 130 is drawn from line power 120 and thus, power manager 110 regulates charging and discharging of battery power 130. In one embodiment, battery power 120 has sufficient capacity to supply power to operate processor 30, transceiver 40 and motion detector 50. In the event of a power outage, wherein the metered electric service is interrupted, module 10 can continue to operate as a battery powered security system.

In various embodiments, battery power 120 is user replaceable or non-user replaceable. A door or other structure on the faceplate of module 10 may provide access to a battery compartment to allow user replacement of battery power 120. In one embodiment, battery power 120 is housed in a sealed structure and is thus non-user replaceable. One example of a long life battery is a lithium battery.

Figure 5:
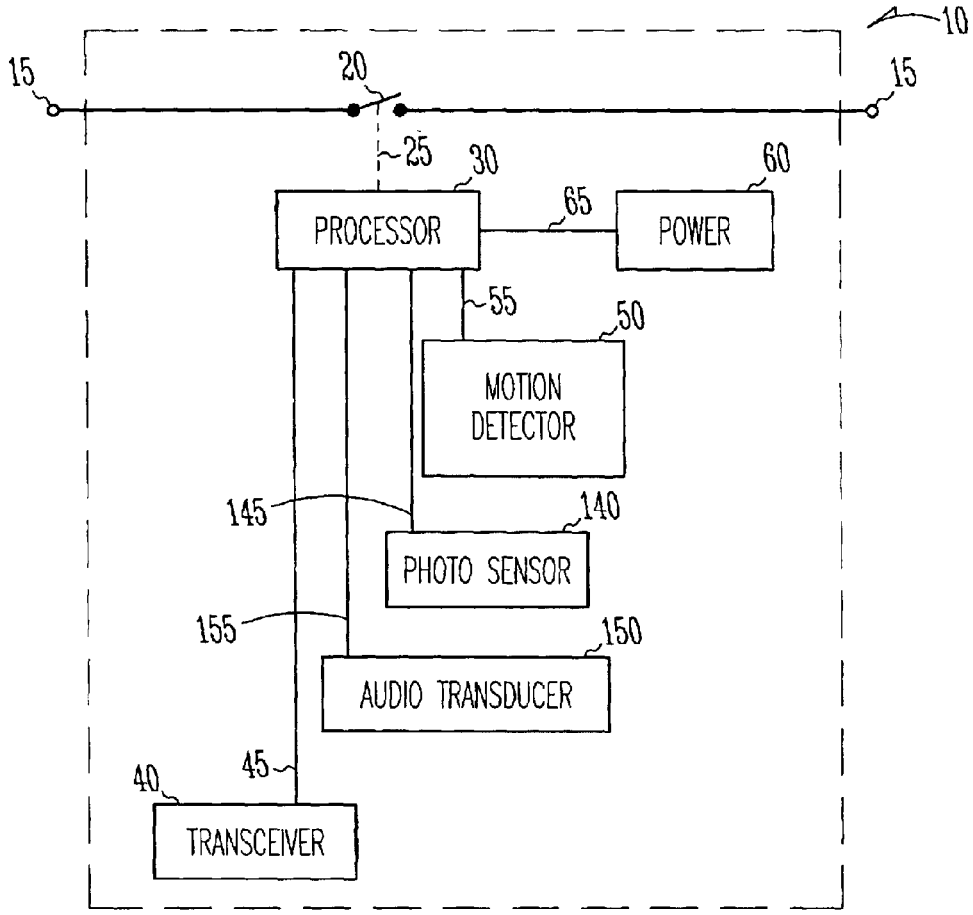
FIG. 5 schematically illustrates an embodiment of the present system having a photosensor and audio transducer.

FIG. 5 illustrates an embodiment of module 10 having switch 20 coupled to processor 30 by link 25. Processor 30 is coupled to power supply 60 by link 65. Motion detector 50 is coupled to processor 30 by link 55. Transceiver 40 is coupled to processor 30 by link 45.

Photosensor 140 is coupled to processor 30 by link 145. In one embodiment, photosensor 140 includes a sensor that generates a signal based on a detected light level. For example, daytime ambient lighting conditions may generate a first signal and nighttime ambient lighting conditions may generate a second signal. The signal generated by photosensor 140 is coupled to processor 30 by link 145. The signal from photosensor 140 can be used to tailor the operation of processor 30, and thus, the operation of load 70, transceiver 40, power supply 60, motion detector 50 and audio transducer 150. For example, in one embodiment, if the signal from photosensor 140 corresponds to a daytime ambient lighting condition, then programming executing on processor 30 disables an automatic light switch function and if the signal indicates a nighttime ambient lighting condition, then the automatic light switch function is operative.

Audio transducer 150 is coupled to processor 30 by link 155. In various embodiments, audio transducer 150 is a piezoelectric transducer, a miniature siren or other device delivering a high sound pressure level. Audio transducer 150 is coupled to the module in a manner such that a relatively high sound pressure level is produced in the region of module 10. Audio transducer 150 may emit a single audio tone or a series of audio tones. Processor 30, via link 155, controls the operation of transducer 150 and may modulate the tone produced. Audio transducer 150 may produce a continuous or discontinuous tone.

Figure 6:
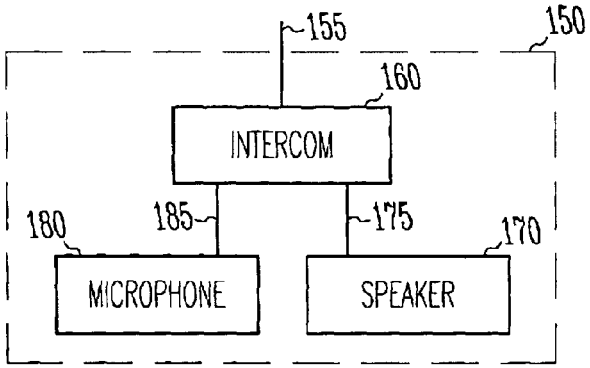
FIG. 6 illustrates an embodiment of an intercom in accordance with one embodiment of the present system.

FIG. 6 illustrates an embodiment of audio transducer 150. In the figure, audio transducer 150 includes intercom 160, microphone 180 and speaker 170. Microphone 180 is coupled to intercom 160 by link 185. Speaker 170 is coupled to intercom 160 by link 175. Microphone 180 and speaker 170 are affixed to module 10 in a manner such that ambient audio is detected by microphone 180 and speaker 170 produces audible sounds near module 10. In one embodiment, intercom 160 includes an audio amplifier and voice operated controls for conducting intercom conversations with a remote device. Sound detected by microphone 180 is converted to a signal that is communicated to intercom 160 via link 185. Intercom 160, in conjunction with processor 30 and transceiver 40, communicates the signal to a remote device where the signal is again converted to audio. Transceiver 40 also receives signals representing audio from the remote device. Received signals are processed by processor 30 and routed to speaker 170 by intercom 160.

In one embodiment, voice recognition circuitry or programming controls the operation of intercom 160. A user with a cellular telephone, for example, can engage in a discussion with another person using the intercom function of module 10. As another example, a user with a cellular telephone can remotely monitor sounds near module 10.

Figure 7:
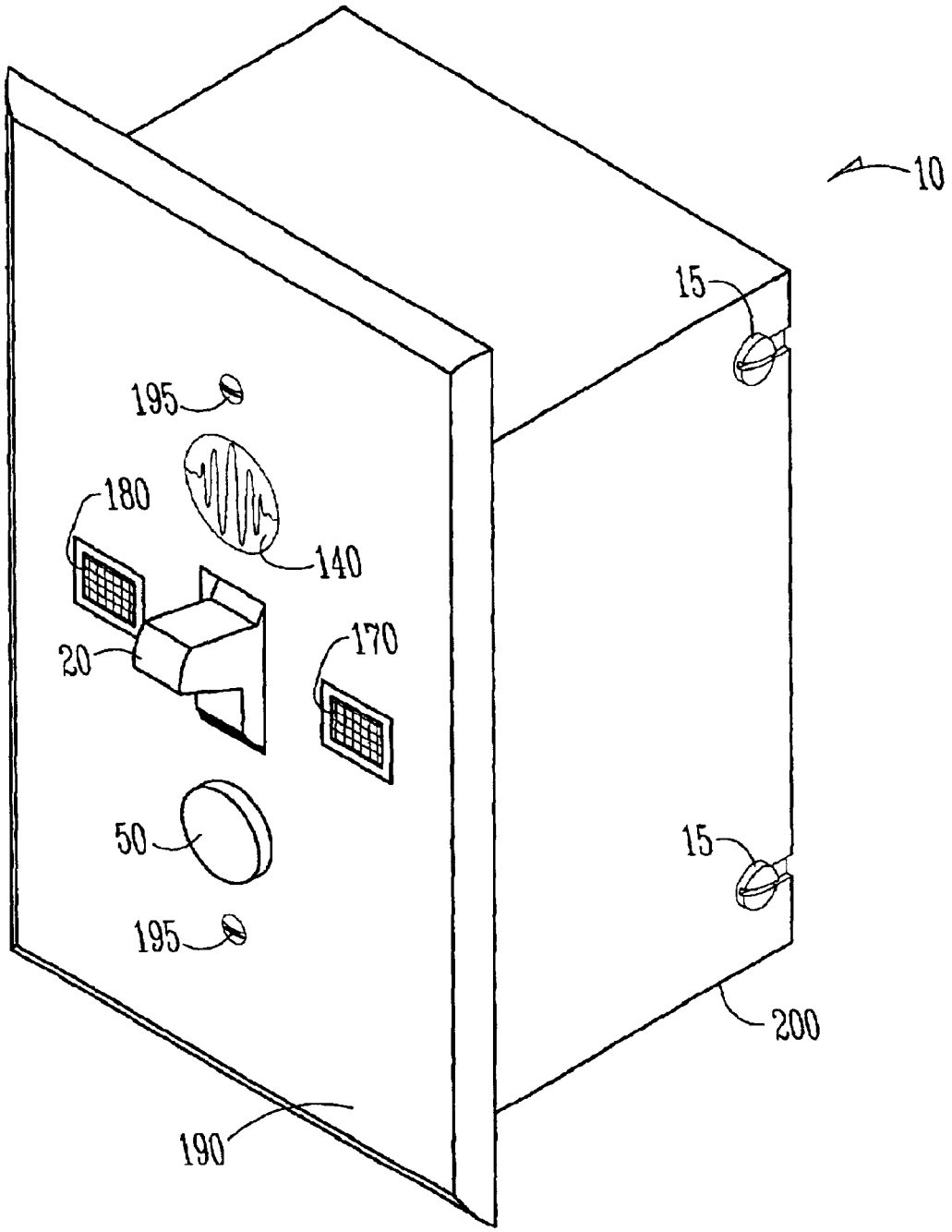
FIG. 7 illustrates a view of one embodiment of the present system.

FIG. 7 illustrates an isometric view of an embodiment of the present subject matter. Module 10 includes user operable switch 20 projecting through decorative faceplate 190. Faceplate 190 is affixed to housing 200. Terminals 15 are positioned on an external surface of housing 200 and include machine screws adapted for securing electrical wires. Faceplate 190 also includes photosensor 140 and motion detector 50. Adjacent to switch 20 are microphone 180 and speaker 170. Screws 195 have machine threads and are adapted to mount module 10 to a UL-listed standard electrical box.

Other Embodiments

Figure 8:
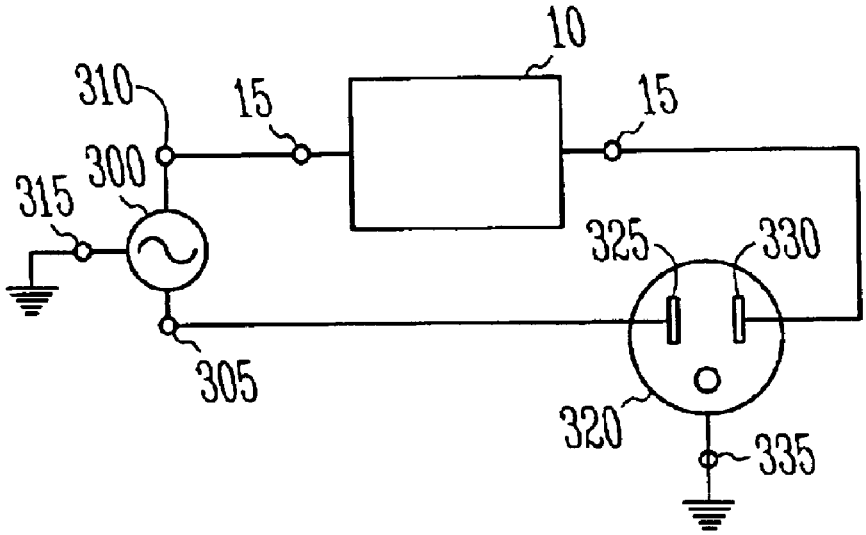
FIG. 8 illustrates a schematic of an embodiment coupled to an electrical outlet.

The present system and method may be adapted for use in embodiments other than that explicitly enumerated above. For example, in one embodiment, the module may include an electrical outlet receptacle and the present subject matter, thus, may control electrical power available from the outlet or power actually consumed by a load coupled to the outlet. In particular, and with reference to FIG. 8, nodes 15 of module 10 are coupled in series with electrical power source 300 and electrical outlet 320. Power source 300 and outlet 320 are each electrically grounded, as shown at 315 and 335, respectively. A first terminal 305 of power source 300 is coupled to a first terminal 325 of outlet 320. A second terminal 310 of power source 300 is coupled, via module 10, to a second terminal 330 of outlet 320. In one embodiment, outlet 320 and module 110 are assembled in a housing having connectors adapted to mate with power terminals coupled to source 300. In one embodiment, outlet 320 and module 10 are adapted for mounting within a UL-listed standard electrical box. Outlet 320 is adapted to receive a plug-in connector cord from an electrical load or appliance. The electrical load may include an appliance such as a lamp, fan, radio, or other electrical device adapted for operation using power drawn from metered electric service.

CONCLUSION

Although specific embodiments have been illustrated and described herein, it will be appreciated by those of ordinary skill in the art that any arrangement which is calculated to achieve the same purpose may be substituted for the specific embodiment shown. This application is intended to cover any adaptations or variations of the present invention. For example, a first module 10 and second module 10 may operate in a master slave, or reciprocal, relationship whereby a first module 10 can receive instructions from, and transmit instructions to, a second module 10. As another example, where both modules include intercom 160, a two way conversation can be established using the present subject matter.

What is claimed is:

1. An apparatus comprising:

an electrical switch having a plurality of positions and adapted for coupling an electrical load to a power source;

a processor coupled to the switch;

a motion detector having a detector output and an optical input, the detector output coupled to the processor; and a wireless transceiver coupled to the processor, the transceiver adapted for wirelessly transmitting an outgoing signal based on the switch position and the detector output and adapted for wirelessly receiving an incoming signal for controlling power applied to the load from the power source.

2. The apparatus of claim 1 wherein the motion detector includes a passive motion detector.

3. The apparatus of claim 1 wherein the motion detector includes a passive infrared motion detector.

4. The apparatus of claim 1 wherein the transceiver is compatible with a cellular telephone communication protocol.

5. The apparatus of claim 1 wherein the transceiver is compatible with a pager communication protocol.

6. The apparatus of claim 1 wherein the transceiver is operable at a frequency of approximately 2.45 GHz.

7. The apparatus of claim 1 wherein the transceiver is substantially compatible with standards under IEEE 802.15.

8. The apparatus of claim 1 wherein the transceiver is substantially compatible with BLUETOOTH® technical specification version 1.0.

9. The apparatus of claim 1 further comprising a battery coupled to the processor, the motion detector and the transceiver.

10. The apparatus of claim 9 wherein the battery is rechargeable.

11. The apparatus of claim 10 wherein the battery is rechargeable from power available to the load.

12. The apparatus of claim 1 further comprising an audio transducer coupled to the processor.

13. The apparatus of claim 12 wherein the audio transducer includes a siren.

14. The apparatus of claim 12 wherein the audio transducer includes a microphone and a speaker.

15. The apparatus of claim 1 further comprising a photosensor having a photosensor output coupled to the processor and adapted for detecting an ambient light level.

16. The apparatus of claim 15 wherein the processor is adapted for controlling the load based on the detected ambient light level.

17. The apparatus of claim 1 wherein the processor is adapted for generating data for generating a website.

18. The apparatus of claim 17 wherein the transceiver is adapted for transmitting the data.

19. The apparatus of claim 17 wherein the transceiver is adapted for receiving instructions for operating the load.

20. A method comprising:

providing a user operable switch having a plurality of positions and adapted for operating an electrical load on an electrical power network;

coupling the switch to a processor having programming for controlling the operating of the switch and for receiving switch position information;

coupling the processor to a wireless transceiver compatible with a network communication protocol; and coupling the processor to a motion detector having an output based on a detected motion.

21. The method of claim 20 further comprising assembling the switch, processor, transceiver and motion detector in a housing.

22. The method of claim 20 further comprising programming the processor to operate the load based on the motion detector output.

23. The method of claim 20 further comprising programming the processor to instruct the transceiver to transmit a command to arm a security system based on the motion detector output.

24. The method of claim 20 further comprising programming the processor to instruct the transceiver to transmit a command to disarm a security system based on the motion detector output.

25. The method of claim 20 further comprising programming the processor to receive instructions from the transceiver for operating the load.

26. The method of claim 20 further comprising programming the processor to instruct the transceiver to transmit an alarm signal based on the motion detector output.

27. The method of claim 20 further comprising providing a photosensor adapted for coupling to the processor wherein the photosensor has a photosensor output based on an ambient light level.

28. The method of claim 20 further comprising providing a battery connector coupled to the processor, the transceiver and the motion detector.

29. The method of claim 20 further comprising providing a microphone coupled to the processor.

30. The method of claim 20 further comprising providing a speaker coupled to the processor.

* * * * *